United States Patent [19]

Bowcott

[11] 4,149,424

[45] Apr. 17, 1979

[54] STARTER MOTOR

[75] Inventor: Roy P. Bowcott, Solihull, England

[73] Assignee: Lucas Industries Limited, Birmingham, England

[21] Appl. No.: 852,324

[22] Filed: Nov. 17, 1977

[30] Foreign Application Priority Data

Nov. 26, 1976 [GB] United Kingdom ..... 49341/76

[51] Int. Cl.[2] ..... F02N 15/06

[52] U.S. Cl. ..... 74/7 A

[58] Field of Search ..... 74/6, 7 R, 7 A

[56] References Cited

U.S. PATENT DOCUMENTS 3,020,771 2/1962 Redick et al. ..... 74/7 A

FOREIGN PATENT DOCUMENTS 2548358 10/1975 Fed. Rep. of Germany ..... 74/7 A
309117 11/1929 United Kingdom.
786938 11/1957 United Kingdom ..... 74/7 A

*Primary Examiner*—Allan D. Herrmann
*Attorney, Agent, or Firm*—Olson, Trexler, Wolters, Bushnell & Fosse, Ltd.

[57] ABSTRACT

A starter motor of the pre-engaged type has a stator, a rotor, a rotor shaft and a pinion assembly mounted on the rotor shaft for rotation therewith and axial movement relative thereto into and out of an operative position. A solenoid is mounted in a casing of the motor and includes a coil and a plunger assembly. The plunger assembly includes a spring biased plunger carrying a plate having a slot therein. A nylon moulding is mounted in the slot and biased by a spring against an end of the slot remote from the plunger. The nylon moulding itself has a pair of slots therein which receive respective ends of a bifurcated lever. The lever is pivoted intermediate its ends and is provided with a yoke connection with the pinion assembly. The bifurcated form of the lever and the slots in the nylon moulding reduce wear of the lever in service.

4 Claims, 4 Drawing Figures

STARTER MOTOR

This invention relates to a starter motor and is particularly concerned with a starter motor for an internal combustion engine, of the pre-engaged type in which thestarter motor pinion is engaged with a toothed starter ring in the internal combustion engine before the rotor of the starter motor is rotated.

It has previously been proposed to provide such a starter motor in which the starter motor pinion assembly is moved by a solenoid including a plunger assembly, via a lever coupled at one of its ends to the pinion assembly and at the other of its ends to the plunger assembly. In such an arrangement, the end of the lever coupled to the plunger assembly comprises a configurated metal finger which engages in an elongate slot formed in a plate projecting axially from the plunger. An abutment flange is slidable in the slot and is urged against the configurated finger by a spring so that the configurated finger is urged by the biased abutment flange into engagement with the end of the slot remote from the plunger.

It has been found with such an assembly that considerable wear occurs in use.

An object of the present invention is to mitigate the above problem.

According to the present invention, there is provided a starter motor comprising a rotor shaft, a pinion assembly mounted on the shaft for rotation therewith and axial movement relative thereto, a solenoid including a plunger assembly, a lever coupled at its one end to the pinion assembly and at its other end to the plunger assembly, said other end of the lever being bifurcated and the bifurcations engaging in respective slots in the plunger assembly.

With the above form of construction, it is found that the wear problem is mitigated.

Preferably the plunger assembly includes a plunger, a plate extending from the plunger, the plunger having a slot therein, a member mounted in the slot for movenent axially of the plunger, and biasing means urging the member towards the end of the slot remote from the plunger, and the slots engaged by the bifurcations are provided in said member.

In order to reduce the wear further, the member is preferably formed of a plastics material, e.g., nylon.

In a preferred embodiment, the member has a tapered recess therein between the slots, the recess accommodating a portion of the plate which defines the end of the slot remote from the plunger.

Preferably, side edges of each bifurcation are convexly curved to assist in relative movement between the lever and the member.

Figure 1:
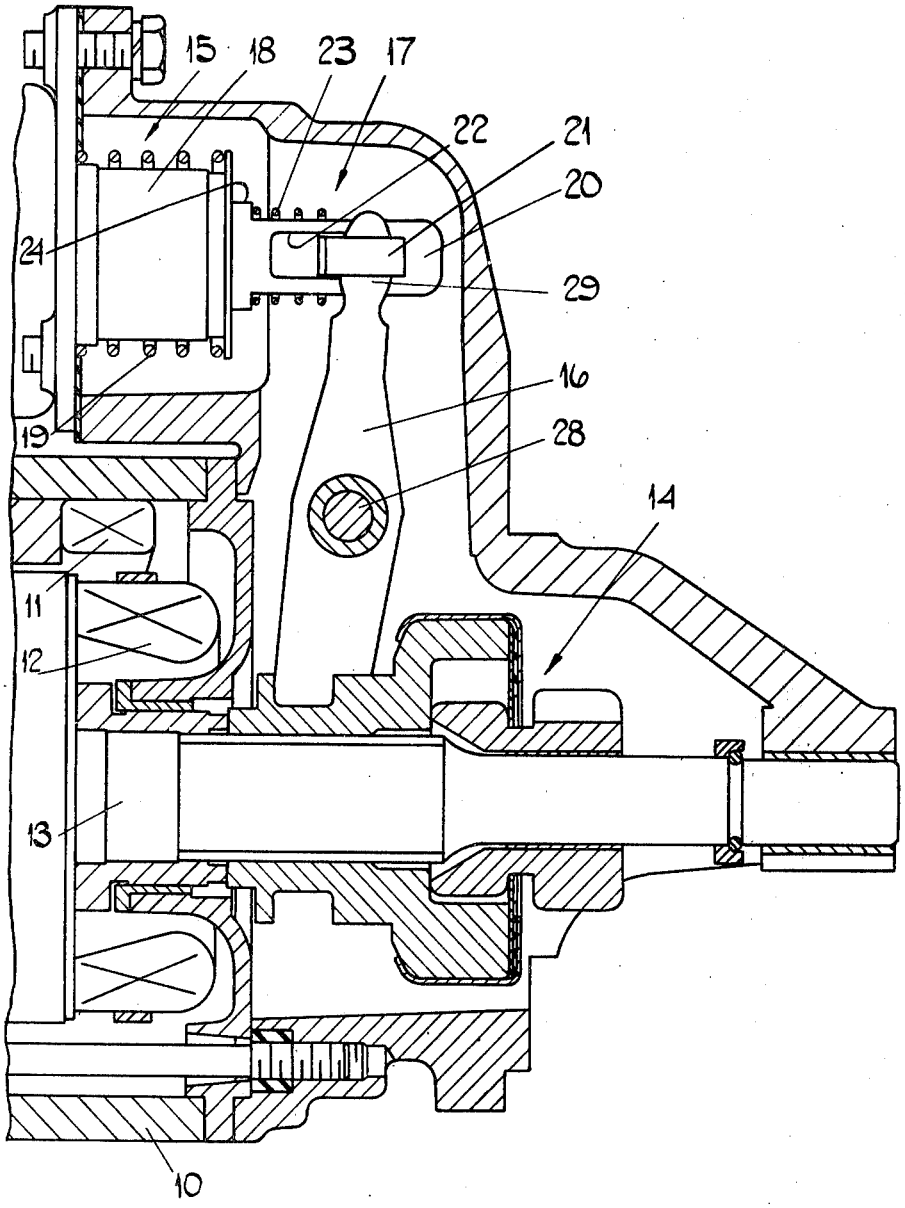
Figure 2:
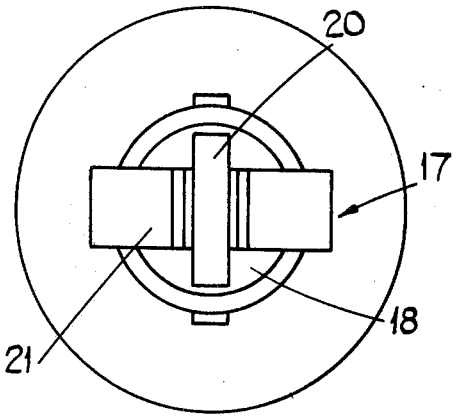
Figure 3:
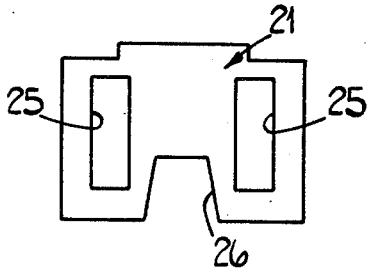
Figure 4:
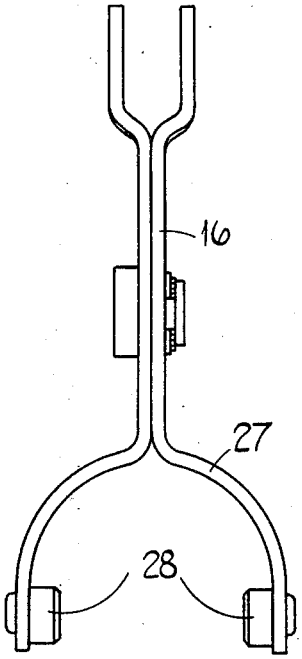

An embodiment of the present invention will now be described, by way of example, with reference to the accompanying drawings, in which:

FIG. 1 is an axial sectional view of a front portion of a starter motor according to the present invention, FIG. 2 is an end view, on a larger scale, of a plunger assembly forming part of the starter motor of FIG. 1, FIG. 3 is a plan view of a moulding forming part of the plunger assembly illustrated in FIG. 2, and FIG. 4 is an elevation of a lever forming part of the starter motor of FIG. 1.

Referring to the drawings, the starter motor is for an internal combustion engine and is of the so-called pre-engaged type. Basically, this starter motor comprises a casing 10 within which is mounted a stator 11, a rotor 12, a rotor shaft 13, a pinion assembly 14 mounted on the rotor shaft 13, a solenoid 15 and a lever 16.

The pinion assembly 14 is movable axially of the rotor shaft from an inoperative position illustrated in full line in FIG. 1 to an operative position illustrated in dotted line in FIG. 1, at which operative position, in use, it engages a toothed starter ring (not shown) in an internal combustion engine to which the starter motor is fitted. The pinion assembly 14 is rotatable with the rotor shaft 15. Axial movement of the pinion assembly 14 is effected by the solenoid 15 through the intermediary of the lever 16.

The solenoid 15 includes a solenoid coil (not shown) and a plunger assembly 17. The plunger assembly 17 comprises a plunger 18 biased by a spring 19 outwardly of the solenoid coil, a plate 20 projecting axially from the plunger 18, and a synthetic plastics member 21 mounted in an elongate slot 22 through the plate 20. The plunger assembly 17 further includes a spring 23 which is lodged between the member 21 and a shoulder 24 so as to urge the member 21 against a portion of the plate 20 which forms an end wall of the slot 22 remote from the plunger 18.

Referring more particularly to FIG. 3, the member 21, which is preferably a nylon moulding, has a pair of spaced slots 25 therethrough which are disposed on opposite sides of the plate 20. The member 21 also has a tapered recess 26 therein in which is engaged the portion of the plate 20 which defines the end wall of the slot 22 remote from the plunger 18. The tapering of the recess 26 ensures re-engagement of the said portion of the plate 20 in the recess 26 in the event that it becomes dis-engaged therefrom in use by compression of the spring 23.

The lever 16 is formed of two sheet metal stampings which are secured together and includes a yoke 27 which engages with the pinion assembly 14 in known manner via lugs 28, which permit rotation of the pinion assembly 14 relative to the lever 16 but serve to effect longitudinal movement of the pinion assembly 14 relative to the motor shaft 13 upon pivotal movement of the lever 16. The lever 16 is pivotally mounted in the casing 10 at 28. The opposite end of the lever 16 to the yoke 27 is bifurcated and the two bifurcations 29 engage in respective ones of the slots 25 in the member 21. As can be seen from FIG. 1, each bifurcation 29 has convexly curved side edges so as to assist in relative movement between the lever 16 and the member 21.

The Applicant has found that the above defined connection between the plunger assembly 17 and the lever 16 is less prone to wear than the previously proposed construction described in the preamble to this specification.

I claim:

1. A starter motor comprising a rotor shaft, a pinion assembly mounted on said rotor shaft for rotation therewith and for axial movement relative thereto, a solenoid including a plunger assembly, and a lever coupled at one end thereof to the pinion assembly and at an opposite end thereof to the plunger assembly, wherein the plunger assembly includes a plunger, a part movable by the plunger, a member slidably mounted on said part, an abutment on said part and biasing means urging said member against said abutment, said member being formed of a plastics material and having a pair of slots therein, and said opposite end of said lever having bifurcations thereon which engage in the respective slots.

2. A starter motor as claimed in claim 1, wherein side edges of each bifurcation are convexly curved to assist in relative movement between the lever and the plunger assembly.

3. The starter motor according to claim 1, wherein said part of said plunger assembly comprises a plate extending from said plunger, and said abutment on said part comprises a plunger-remote end of a slot in said plate, the slots in said member being disposed on opposite sides of said plate.

4. A starter motor as claimed in claim 3, wherein the member has a tapered recess therein between the slots, the recess accommodating a portion of the plate which defines the end of the slot remote from the plunger.

* * * * *